United States Patent [19]

Eng et al.

[11] Patent Number: 4,957,431

[45] Date of Patent: Sep. 18, 1990

[54] HEATING MANTLE WITH A POROUS RADIATION WALL

[75] Inventors: Meng-Teck Eng, Wayne; H. Kenneth Staffin, Colonia, both of N.J.

[73] Assignee: Gas Research Institute, Chicago, Ill.

[21] Appl. No.: 359,973

[22] Filed: Jun. 1, 1989

[51] Int. Cl.[5] ..... F27B 3/20

[52] U.S. Cl. ..... 432/31; 432/147; 432/175; 432/222

[58] Field of Search ..... 432/222, 223, 209, 147, 432/175

[56] References Cited

U.S. PATENT DOCUMENTS

| | | | |
|---|---|---|---|
| 3,182,982 | 5/1965 | Ruff | 432/147 |
| 3,193,263 | 7/1965 | Ruff | 432/147 |
| 4,363,623 | 12/1982 | Brune | 432/223 |
| 4,421,474 | 12/1983 | Meyer | 432/222 |
| 4,790,749 | 12/1988 | Mauro | 432/59 |
| 4,792,302 | 12/1988 | Baker et al. | 432/175 |
| 4,850,860 | 7/1989 | Albonetti | 432/175 |

*Primary Examiner*—Henry C. Yuen

*Attorney, Agent, or Firm*—Kane, Dalsimer, Kurucz, Levy, Eisel and Richard

[57] ABSTRACT

A heating mantle for heating materials in a retort includes a housing for a chamber holding the retort, a source of hot gases and a porous wall. The gases pass through the porous will which heats the retort. The heating takes place in a so-called porous wall radiation barrier process. In the first step, the gases passing through the wall heating it be convection. In the second stage, the heated porous wall radiates heat towards said retort.

12 Claims, 2 Drawing Sheets

HEATING MANTLE WITH A POROUS RADIATION WALL

BACKGROUND OF THE INVENTION

1. Field of Invention

This invention pertains to a gas-fired heating mantle for heating a retort furnace, and more particularly to a heating mantle with a porous wall disposed in the path for the combustion gases for raising the efficiency of heat transfer to the furnace.

2. Description of the Prior Art

Gas-fired heating mantles are used extensively in the metal processing industry for treating and processing metals and alloys, as well as in the inorganic chemical industry in reactors. However present mantles are severely deficient in a number of areas which limits their use in commercial applications. The primary deficiency of present heating mantles is limited heat transfer rate from the mantle to the retort.

Typically, a gas-fired heat mantle surrounds a furnace retort vessel, and is constructed to provide a high rate of heating in a small space.

Typically, the mantle is made of a steel shell with an inside lining of insulating refractory and must be shaped to direct combustion flames away from the retort vessel to avoid damaging it. In this configuration, heat is transferred to the retort primarily through two mechanisms: one, by convective heat transfer from the combustion gases to the interior mantle wall and the retort vessel wall, and two, by radiation from the interior mantle wall to the retort vessel wall. In a gas-fired heating mantle, at temperatures below 1200° F., the radiation heat transfer rates are low due to lower temperatures, and the convective heat transfer rates are generally low due to low gas velocities. This combination results in low overall heat transfer rates.

At temperatures above 1400° F., heat transfer by radiation from the mantle wall occurs at high rates, however, the convective rates to the heating mantle wall remain low and becomes the rate limiting step in the overall heat transfer process. This keeps the overall heat transfer rates low.

Typically, present heating mantles have a heat transfer rate in the range of 5–15 BTU/sq. ft.-hr.-degree F. depending upon temperature level and gas flow rates.

OBJECTIVES AND SUMMARY OF THE INVENTION

In view of the above disadvantages of the prior art, it is an objective of the present invention to provide a heating mantle with an improved overall heat transfer rate, in the range of 15–60 BTU/sq. ft.-hr. degree F., depending upon temperature level and gas flow rates.

The objective is accomplished by providing a heating mantle with an innovative geometric configuration for improved heat transfer by a combined convection and radiation process.

Other objectives and advantages of this invention shall become apparent from the following description of the invention. A heating mantle constructed in accordance with this invention comprises a housing having a chamber surrounding a retort or furnace holding the material to be heated. Between the retort and the chamber there is a porous wall disposed in the path of the combustion gases used to heat the mantle. The porous wall is arranged and disposed so that it is convectively heated by the gases passing through the pores and radiates heat from its surface facing the retort to the surface of the retort. Because of the large contact surface between the porous wall and the gases, the porous wall is heated at a high heat transfer rate and can radiate to the retort wall at a high heat transfer rate. More specifically, the face through which the gases enter the wall is heated to a temperature substantially equal to the temperature of the combustion gases entering through the face of the porous wall. Since the convective mechanism of heat transfer, which is usually the rate limiting step, has been increased in rate by the large area of contact in the surface of the porous wall, it permits the series mechanism of convection/radiation to proceed at a significantly higher overall rate of heat transfer. Thus in the present invention, a two step heating process takes place. In the first step, combustion gases pass through the porous wall heating it, and specifically its surface, by high rate convection. In a second step, the porous wall surface heated by the gases radiates heat at characteristically high rates, particularly at temperatures above 1200° F., to the retort thereby improving the overall heat transfer characteristics of the mantle. This process is termed a porous wall radiation process or principle and its results in a heat transfer capability in the range of 25–60 BTU/hr-sq.ft- degree F.

DETAILED DESCRIPTION OF THE INVENTION

Figure 1:
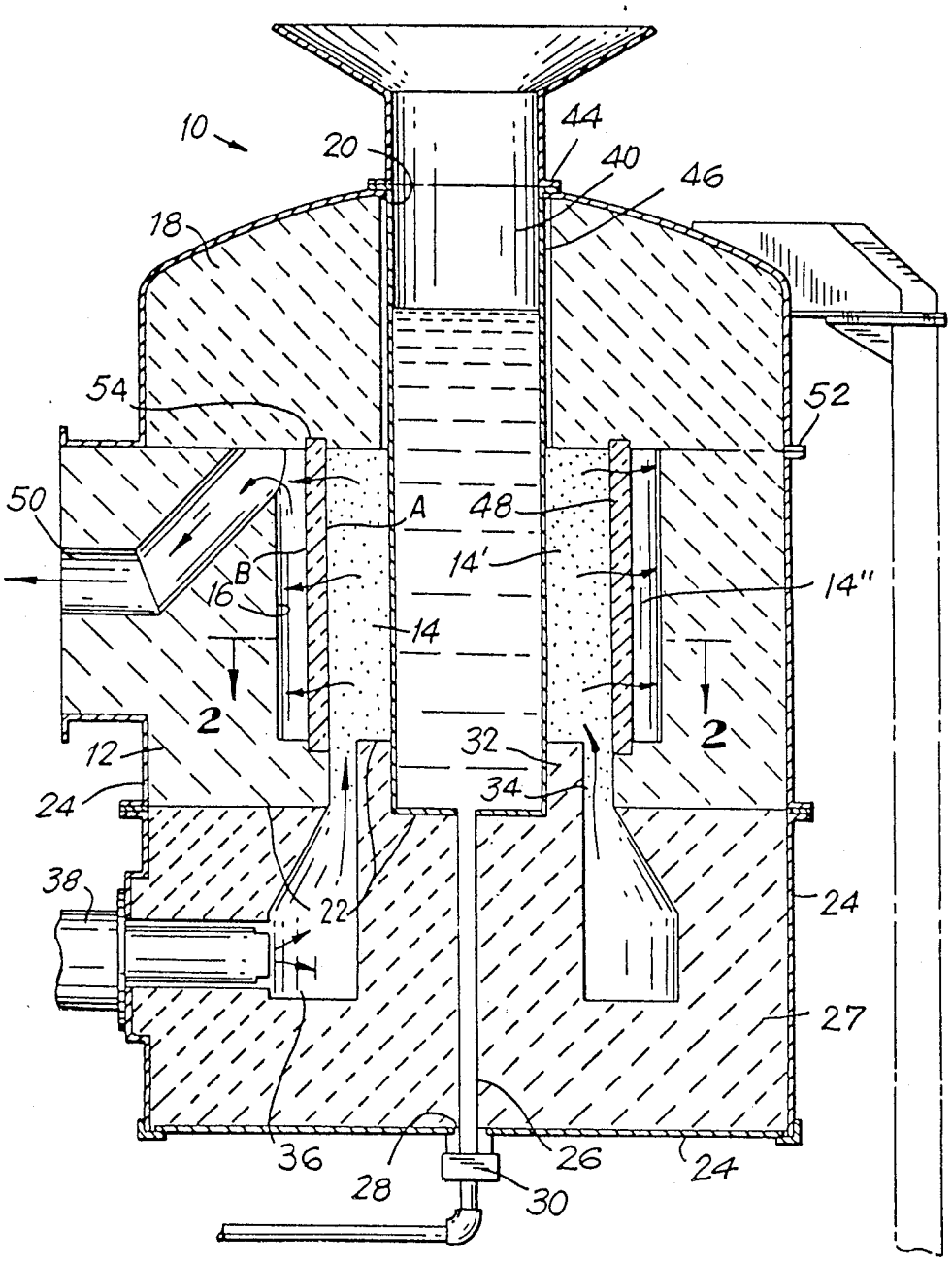
FIG. 1 shows a side elevational cross-sectional view of a mantle constructed in accordance with this invention, and shown as applied to the configurations of heating a cylindrical retort vessel.
Figure 2:
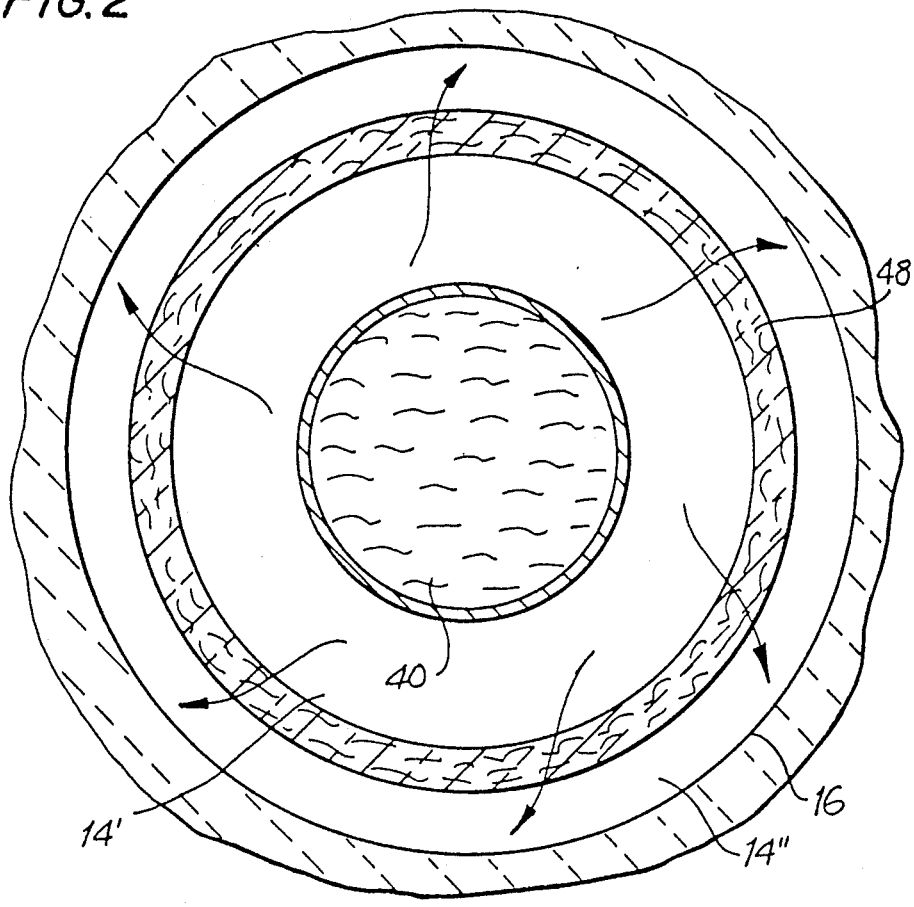
FIG. 2 shows a plan cross-sectional view of the mantle of FIG. 1.
Figure 3:
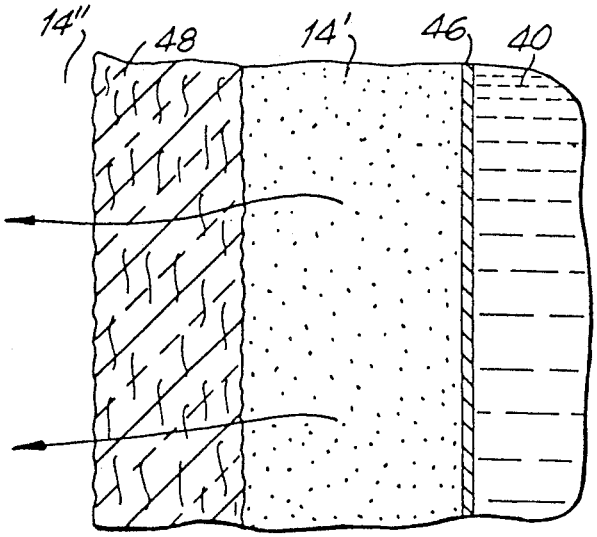
FIG. 3 is a partial detailed side view of the gases traversing the porous wall of the mantle in FIG. 1.

Referring now to the drawings, a heating mantle 10 constructed in accordance with this invention comprises a housing 12 made of an insulation material inside a steel shell 24. The housing defines an interior chamber 14 with an outer wall 16.

The chamber 14 is closed off at the top by a cap 18 with an opening 20. The chamber also has a floor 22 formed by lower housing 27. The lower housing 27 forms a cylindrical protective wall 32. Protective wall 32 and outer wall 16 define an annular passageway 34 to a lower chamber 36. One or more burner systems 38 are arranged and constructed to inject combustion gases into the lower chamber 36.

Supported on floor 22 within protective wall 32 there is a retort vessel 40 for holding the materials that are to be treated. The interior of the retort vessel 40 is in communication with pipe 26 for receiving and/or discharging materials to be treated in the retort. The pipe 26 passes through the lower housing and out through the opening 28 in the shell. A packing gland seal 30 is provided between the opening 28 and pipe 26 to prevent heat and combustion gases from escaping from chamber 14.

The retort extends through the opening 20 past cap 18. The opening is sealed around the retort at 44. The retort has an outer wall 46.

In chamber 14, between retort outer wall 46 and the wall 16 there is a porous cylindrical wall 48 defined between an inner face A directed toward the retort vessel 40, and an outer face B directed toward surface 16 which effectively divides chamber 14 into two annular sections: a first section 14' defined between the retort wall 46 and porous wall 48, and a second annular section 14" concentrically disposed around the first section 14' and defined between the porous wall 48 and outer wall 16. An exhaust opening 50 is in connection with the second section 14". Preferably, porous wall 48 is terminated with a groove 54 which is formed in cap 18. Construction of housing 12 and cap 18 is facilitated by flange 52 which connects these two sections.

The heating mantle operates as follows. After material is disposed in retort vessel 40, the burner system 38 is started up which causes high temperature combustion gases to flow into lower chamber 36. The combustion gases in this chamber are typically between 1000° F. and 2700° F. These combustion gases flow from the lower chamber 36 through annular passsageway 34 into the inner or first chamber section 14'. At the point of entry into this chamber section 14', these gases are very hot and therefore the retort wall is protected from extreme temperatures by protective wall 32. From the inner chamber section 14' the combustion gases pass through porous wall 48 into the second chamber section 14" and are then exhausted through flue opening 50. As the gases pass through the inner face A of the wall directed toward the retort 42, the face gets heated to a temperature substantially equal to the temperature of the combustion gases. This porous wall face A radiates heat to the retort wall.

Preferably wall 48 is made of porous ceramic, for example silcon carbide. For a mantle having an inner chamber with a diameter of 34 inches, and a height of 48 inches and a retort of 24 inches outside diameter, the wall 48 may be for example 1½ inches thick.

Shell 24 is made preferably of steel. The housing 12, cap 18 and lower housing 27 are made preferably of cast refractory. The retort is typically made of a high nickel alloy steel or high thermal conductivity ceramic.

Obviously numerous modifications may be made to the present invention without departing from their scope as defined in the appended claims.

What is claimed is:

1. A heating mantle for heating materials comprising:

a. material holding means for holding said material;

b. a housing defining a chamber which substantially surrounds said material holding means;

c. a source of hot gases constructed and arranged for supplying hot gases through said chamber in a preselected path;

d. porous wall means defined between a first face directed toward said material holding means, and an opposed second face and disposed in said chamber in said path with said gases entering said porous wall means through said first face for receiving heat from said hot gases, said first face radiating heat toward said material holding means wherein said gases flow from said first face to said second face; and e. means for exhausting said gases after said gases passed through said second face.

2. The heating mantle of claim 1 wherein said porous wall means divides said chamber into a first chamber section, defined between said porous wall means and said material holding means, and a second chamber section defined by said porous wall means and said housing.

3. The heating mantle of claim 1 wherein said porous wall means is constructed and arranged in said path with said gases flowing through said porous wall means.

4. The heating mantle of claim 1 further comprising a passageway for leading said hot gases into said chamber and protective wall means disposed adjacent said passageway for protecting said material holding means from said hot gases.

5. A method of heating materials comprising:

a. providing a porous member defined between a first face and a second face;

b. passing hot gases through said porous member from said first to said second face for heating said first face to a high temperature by convection;

c. heating said material by radiation from said first face;

d. disposing said porous member concentrically around said material;

e. passing said gases from a space between said materials and said porous wall through said porous wall; and f. exhausting said gases after said gases passed through said second face.

6. A heating mantle comprising:

a. a housing defining a chamber;

b. retort means disposed substantially coaxially within said chamber;

c. a furnace system for providing hot gases into said chamber in a hot gas path;

d. a porous wall defined between an inner face directed toward said retort means and an outer face, and disposed in said hot gas path said hot gases entering said porous wall through said inner face for heating said inner face, said inner face radiating heat toward said retort means wherein said hot gases flow from said inner face to said outer face; and e. means for exhausting said hot gases after said hot gases passed through said outer face.

7. The heating mantle of claim 6 wherein said chamber is cylindrical and said retort is disposed along a longitudinal axis of said chamber.

8. The heating mantle of claim 7 wherein said porous wall is disposed around said retort.

9. The heating mantle of claim 8 wherein said porous wall divides said chamber into a first and second chamber section, and wherein said gases flow from said first to said second chamber section through said porous wall.

10. The heating mantle of claim 7 further comprising a combustion chamber connected to said furnace for burning gases, and a passageway connected between said combustion chamber toward said porous wall.

11. The heating mantle of claim 6 wherein said housing includes a cap for closing said chamber, and wherein said porous wall is compressed by said cap to form a seal to flowing gases.

12. The heating mantle of claim 11 further comprising a sealing gasket disposed between said cap and said porous wall.

* * * * *